US009415285B1

(12) United States Patent
Jolly

(10) Patent No.: US 9,415,285 B1
(45) Date of Patent: Aug. 16, 2016

(54) BREAKAWAY BASKETBALL RIM ASSEMBLY

(71) Applicant: Jim Jolly, Falls of Rough, KY (US)

(72) Inventor: Jim Jolly, Falls of Rough, KY (US)

( * ) Notice: Subject to any disclaimer, the term of this patent is extended or adjusted under 35 U.S.C. 154(b) by 0 days.

(21) Appl. No.: 14/849,033

(22) Filed: Sep. 9, 2015

(51) Int. Cl.
*A63B 63/08* (2006.01)

(52) U.S. Cl.
CPC ..... *A63B 63/083* (2013.01); *A63B 2063/086* (2013.01)

(58) Field of Classification Search
CPC . A47B 57/04; A63B 2063/086; A63B 63/083
USPC ..... 473/485–489; 248/242, 548, 900; 16/72, 284, 286, 289
See application file for complete search history.

(56) References Cited

U.S. PATENT DOCUMENTS 2,219,820 A * 10/1940 Schonitzer ..... E05F 1/1253 16/221
5,348,289 A 9/1994 Vaught
5,464,207 A 11/1995 Boitano
6,080,071 A 6/2000 Childers et al.
6,702,246 B1 * 3/2004 Schriever ..... F16M 7/00 248/656
7,628,718 B2 12/2009 Connerley
7,798,921 B2 9/2010 Connerley
8,454,460 B2 * 6/2013 Connerley ..... A63B 63/083 473/486

* cited by examiner

*Primary Examiner* — Melba Bumgarner
*Assistant Examiner* — Laura L Davison
(74) *Attorney, Agent, or Firm* — Middleton Reutlinger

(57) ABSTRACT

A breakaway basketball rim assembly that deflects from a rest position to a displaced position in response to sufficient forces imposed on the rim. The rim assembly may have a fixed portion coupled to a backboard and a movable portion with a basketball rim. The basketball rim may pivot without the forces to activate the breakaway feature. The rim assembly may also have one or more leveling mechanisms to level the basketball rim assembly in a horizontal position relative to the backboard.

18 Claims, 19 Drawing Sheets

BREAKAWAY BASKETBALL RIM ASSEMBLY

FIELD OF THE INVENTION

The present disclosure relates to basketball goals, more specifically a basketball rim which is capable of deflecting in one or more directions upon application of sufficient force, such as from, but is not limited to, a dunk shot, to prevent damage to the rim and associated backboard to which the rim is mounted. In particular, it relates to such a rim that may automatically return to an original position upon removal of the force.

BACKGROUND

Breakaway basketball rim assemblies typically include a spring energy basketball goal/backboard unit incorporated into a conventional vertically aligned backboard and horizontally aligned goal, i.e., the rim. The rim can be spring mounted to pivot relative to the backboard forwardly and downwardly out of its normal horizontal plane when a predetermined excess force is applied such as when a player dunks the basketball and slaps, hits or pulls the rim with his hands, wrists, or arms. The rim may then return to its original position with the spring energy of the return motion being dissipated by the spring portion. Provision can also be made for the rim to deflect sideward. The spring portion providing the return forces may be mounted in front of the backboard and connected to the rim.

BRIEF DESCRIPTION OF THE DRAWINGS

In the drawings, like reference characters generally referred to the same parts throughout the different views. Also, the drawings are not necessarily to scale, emphasis instead generally being placed upon illustrating the principals of the invention.

DETAILED DESCRIPTION OF EMBODIMENTS WITH THE DRAWINGS

Figure 1:
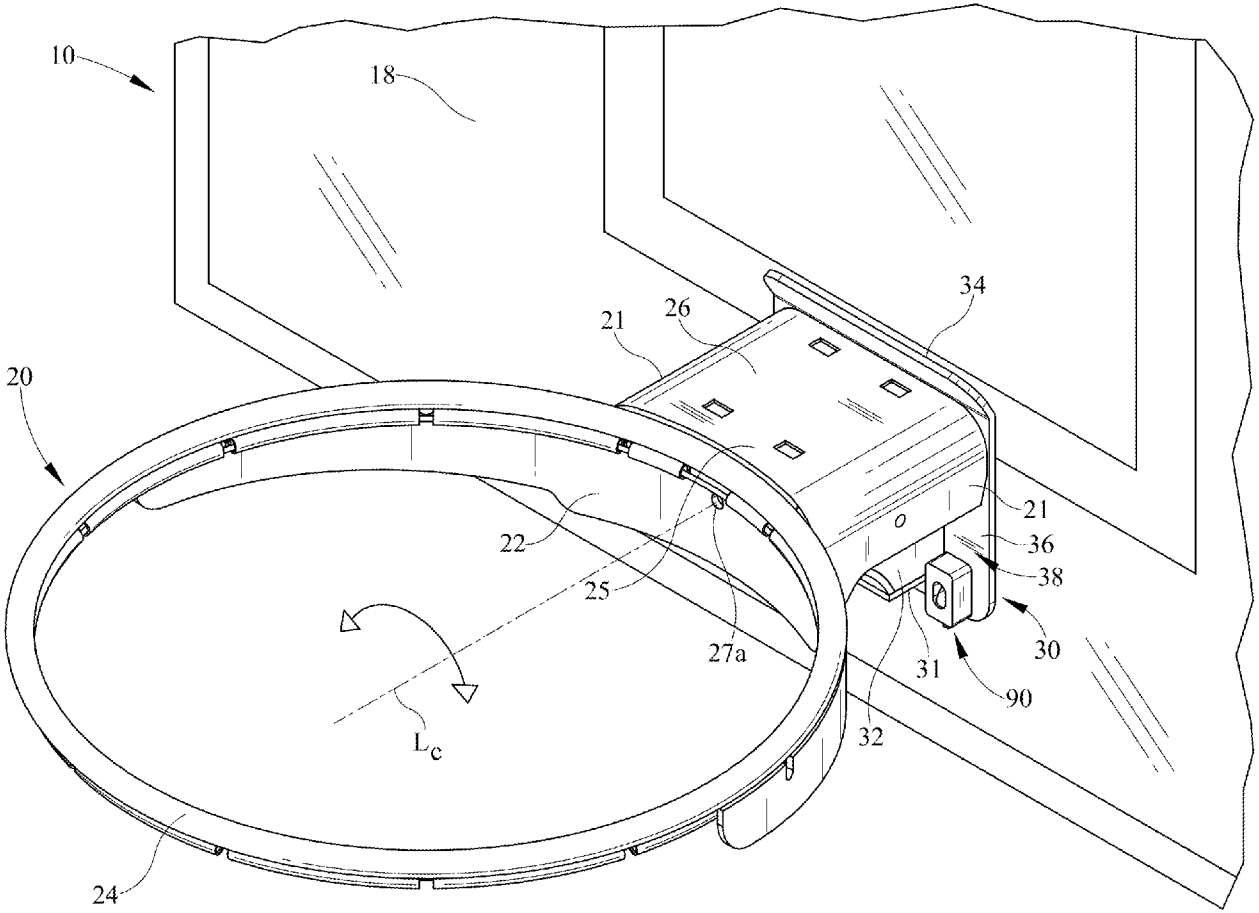
FIG. 1 is a perspective view of a basketball rim assembly mounted to a backboard in a rest position.
Figure 2:
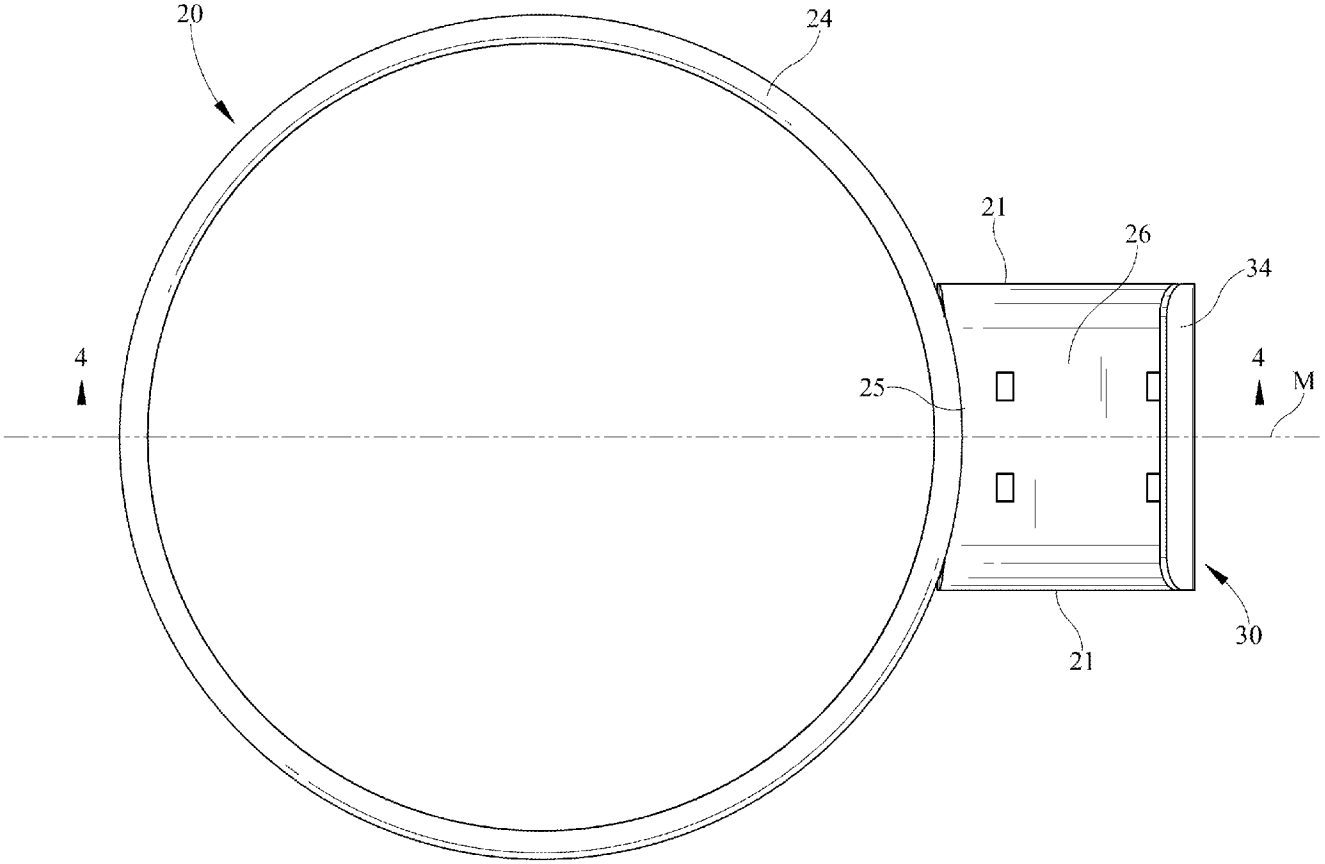
FIG. 2 is a top view of the basketball rim assembly of FIG. 1.
Figure 3:
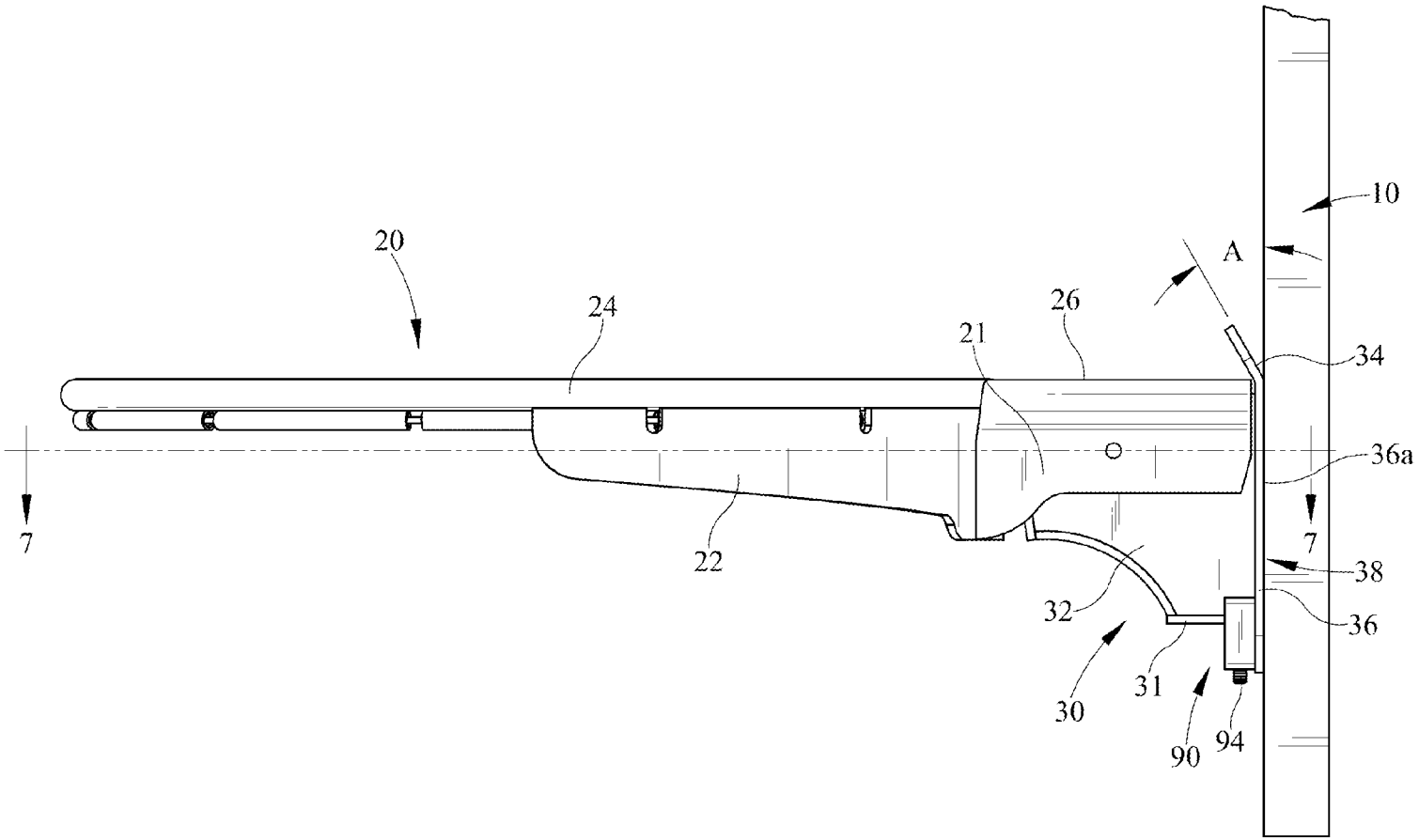
FIG. 3 is a side view of the basketball rim assembly of FIG. 1 in a rest position.

Where like reference numerals are used throughout the figures to designate like component, the figures depict a basketball rim assembly 20. In FIG. 1, the basketball rim assembly or apparatus 20 may be mounted to a vertical backboard 10 so that a rim 24 of the assembly 20 is in the conventional horizontal position. A net, not shown, can be suspended from the rim 24 in the typical manner. The rim 24 can be fixed to a top plate 26, which may extend from a back segment 25 of the rim to the front surface 18 of the backboard 10. Opposing side plates 21 can be fixed to the top plate 26 to extend downward over, and outside of, bracket plates 32 of a mounting frame 30, which can be fixed to the backboard 10. An arcuate reinforcement 22 can be provided depending from the rim 24 to ensure that the rim has the desired stability with respect to the top plate 26 and side plates 21. One or more, or portions thereof, of rim 24, longitudinal carrier 50, rolling cam 40, and/or biasing element 49 can be joined together to form a unitized structure that can move or pivot as a movable portion 20*a* in relation to the backboard 10, mounting frame 30, and/or other structure, described below, that is fixed to the backboard 10.

FIGS. 2-5, 10 and 15 illustrate the mounting frame 30 that may have bracket plates 32 that can be fixed to each other by a mounting plate 38 and a base plate 31. The mounting plate 38 can be fixed to the backboard 10 by suitable fasteners, not shown, that extend in one or more through openings 33 formed in the mounting plate 38. For example, the fasteners may be, but are not limited to, bolts. The mounting plate 38 can have a forward extending portion 34 along the top portion thereof that extends away from a general planar portion 36 to which the bracket plates 32 can be fixed. The forward extending portion 34 can be angled away from the planar portion 36 by an angle A in the range of about 10-30 degrees, and preferably about 20 degrees. A cam surface 39 can be formed or as shown in one embodiment attached to the mounting plate 38. The cam surface 39 may include an angled surface, relative to the horizontal, configured to guide a rolling cam 40.

As shown in FIGS. 4-12 and 14, a rolling cam 40 operably engages the cam surface 39 of the mounting plate 38. The rolling cam 40 is tensioned in one embodiment by a spring and screw to apply the force or pressure desired to have the rim 24 urge back to the rest or horizontal position. The rolling cam 40 pivots with the rim 24.

The rolling cam 40 is slideable within a tubular body 52 of a longitudinal carrier 50, such that the rolling cam 40 and the force it applies to the cam surface 39 is perpendicular to the pivot axis P in a direction along its longitudinal axis Lr. The force intersects the pivot axis P in the embodiment shown. The rolling cam 40 and/or the biasing element 49 slides or is in a sliding engagement with the carrier 50 at least during the movement of the rim 24 from the rest position (FIG. 3) to the displaced position (FIG. 6) and pivots about the pivot axis P. The rolling cam 40 slides within the through opening 58 of the longitudinal carrier body 52 along the longitudinal axis Lc of the carrier 50. Therefore the longitudinal axis Lr of the rolling cam 40 is coaxially aligned with the longitudinal axis Lc of the carrier 50 when assembled. The rolling cam 40 translates along the midplane M of the rim assembly 20. The rolling cam 40 is in a rolling engagement with the cam surface 39 of the mounting plate 38. The rolling engagement allows the cylinder 70 to have a rolling contact of its circumferential surface with the cam surface 39 when the carrier 50 with rolling cam 40 pivots between the rest position and the displaced position. As opposed to an object that is pushed on its exterior surface to slide across a surface, the rolling engagement between the rolling cam 40 and the rotating cylinder 70 may, but is not limited to, reduce friction and may reduce the amount of lubricant that may be used and/or reduce the frequency lubricant is applied.

Figure 11:
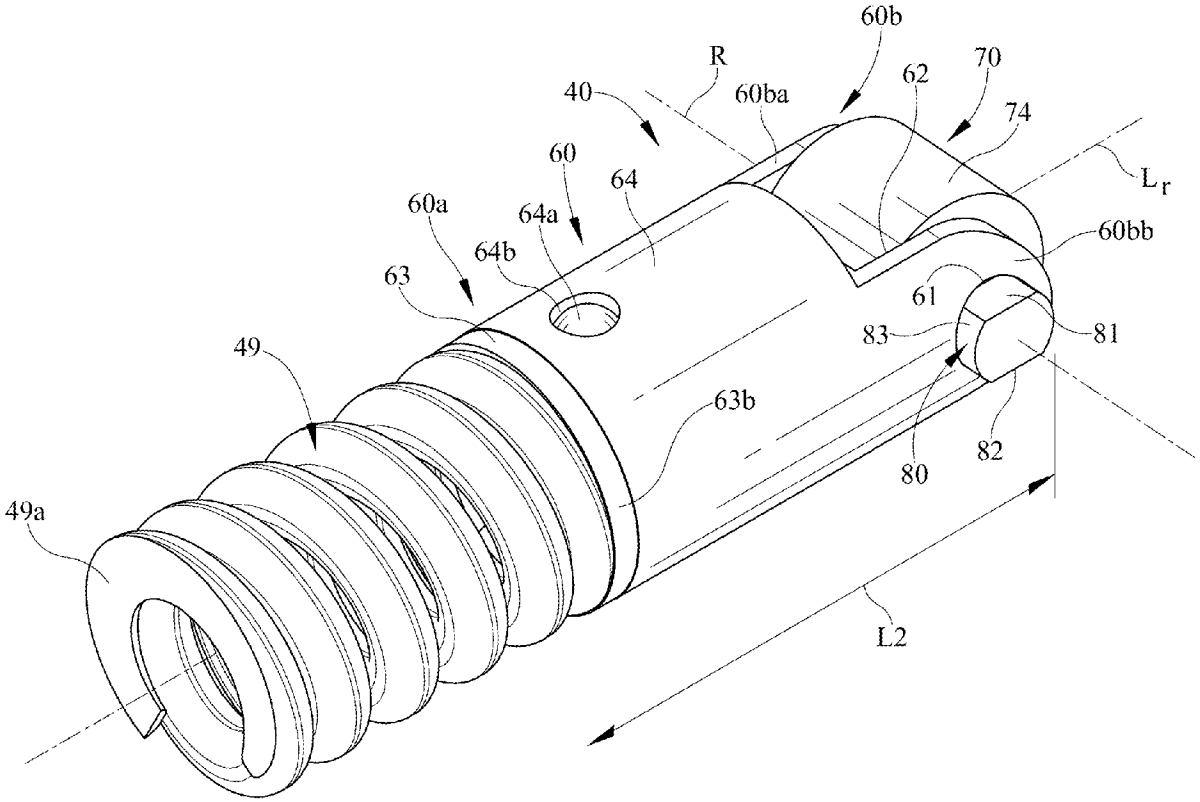
FIG. 11 is a perspective view of the rolling cam and biasing member removed from the longitudinal carrier illustrating a first overall length of the shaft.
Figure 12:
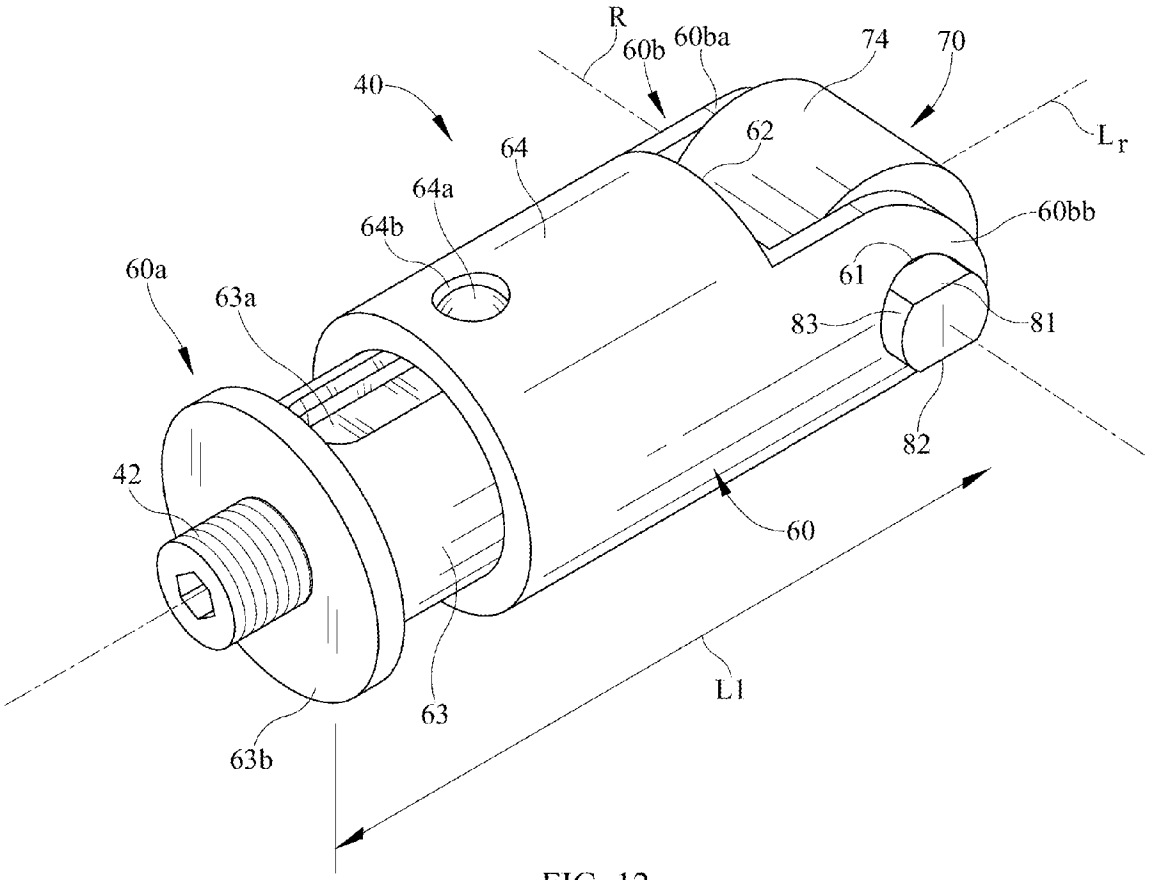
FIG. 12 is a perspective view of the rolling cam illustrating a second overall length of the shaft, with the biasing element removed.
Figure 13:
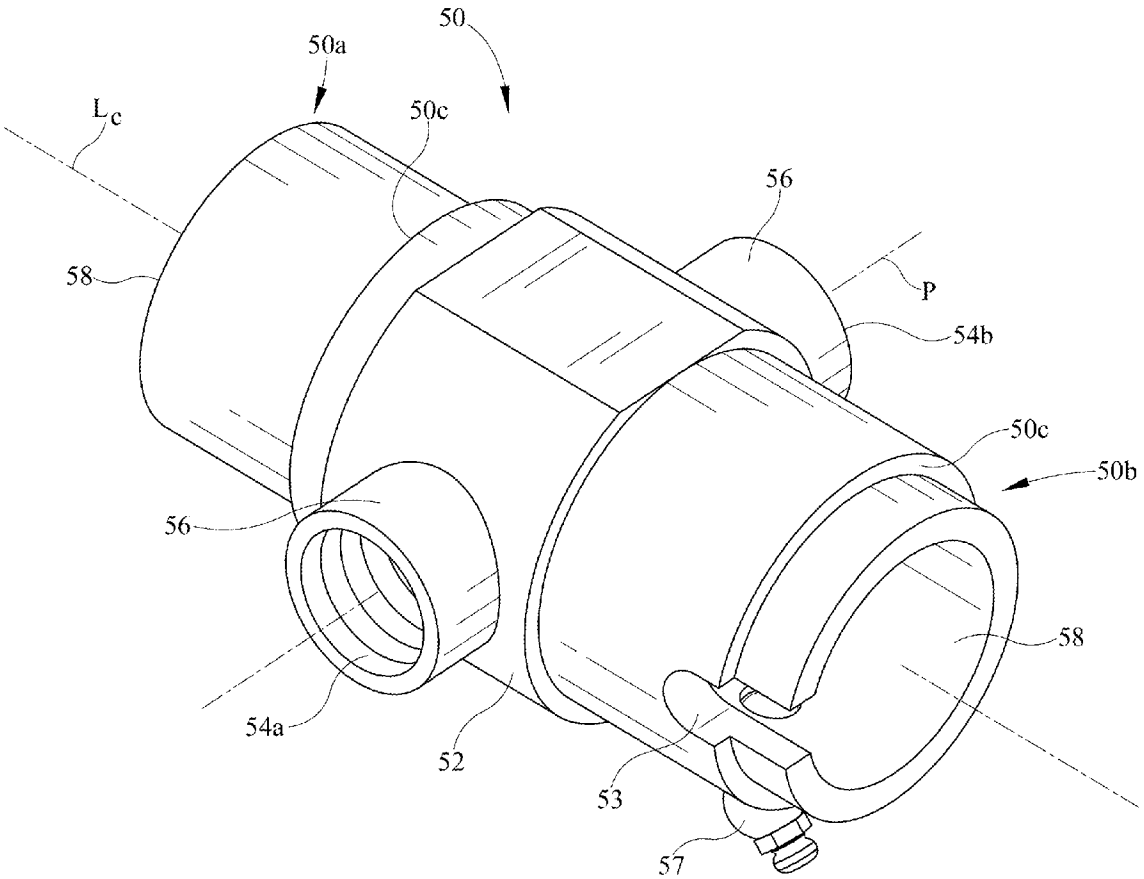
FIG. 13 is a perspective view of the longitudinal carrier of the basketball rim assembly.
Figure 14:
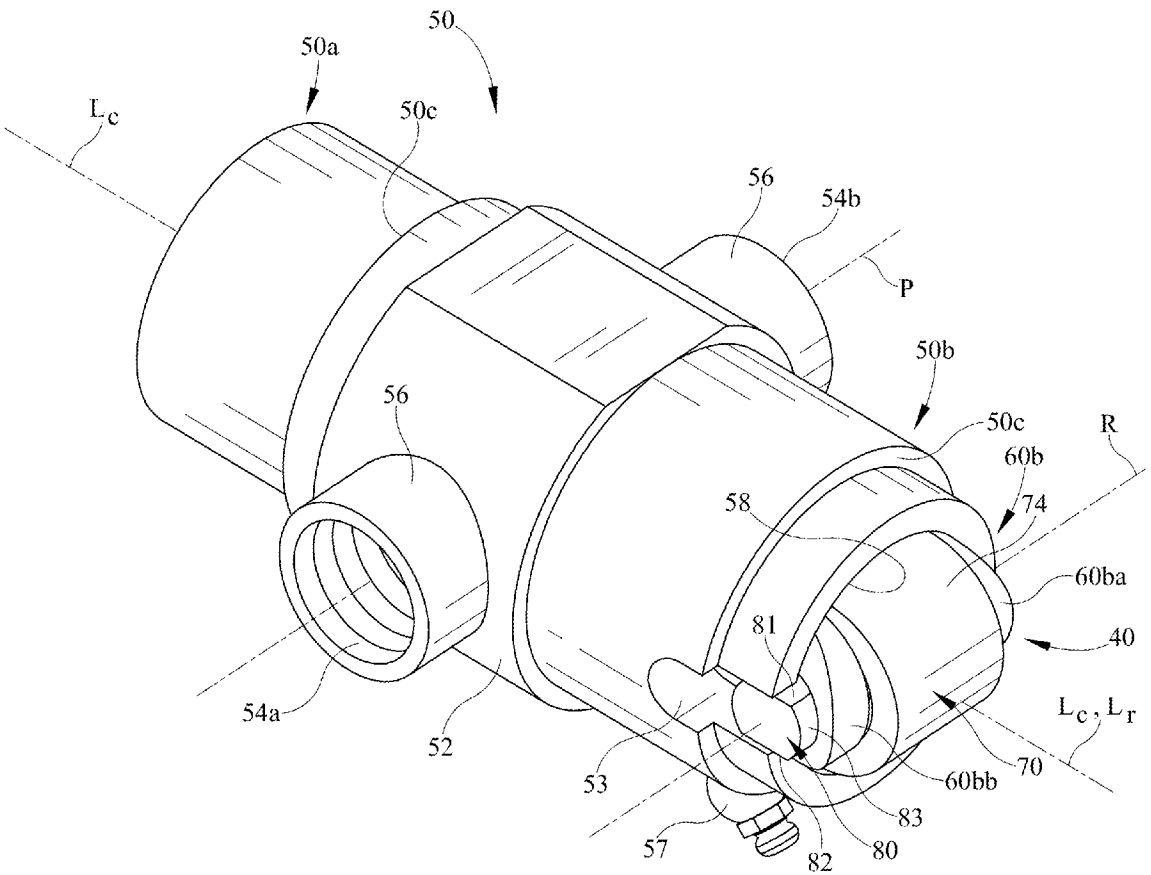
FIG. 14 is a perspective view of the longitudinal carrier of FIG. 13 with a through opening receiving the rolling cam of FIG. 11.
Figure 15:
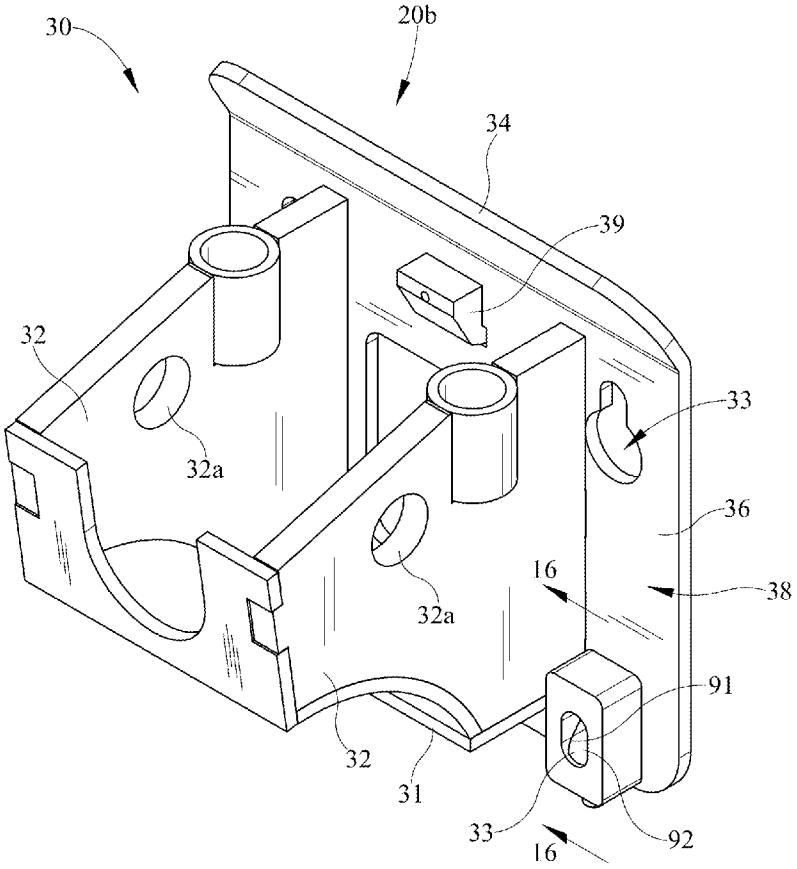
FIG. 15 is a perspective view of the mounting frame of the basketball rim assembly of FIG. 1.

As shown in FIGS. 11 and 12, the rolling cam 40 includes an elongated shaft 60 having a first or proximal end 60*a* and second or distal end 60*b*. Shaft 60 is slidably positioned within the through opening 58 of the carrier 50. The proximal end 60*a* of the shaft 60 engages a biasing element 49, one embodiment of the biasing element 49 is a tension spring as shown. The biasing element 49 is adjustable to either increase or decrease the pressure or tension applied between the cylinder 70 and the cam surface 39. The distal end 60*b* includes the cylinder or first cylinder member 70 rotating relative to the shaft 60 about a rotational axis R that may be substantially perpendicular to the longitudinal axis Lr of the shaft 60. Also, a longitudinal axis of the cylinder 70 may be described as perpendicular to the longitudinal axis Lr of the shaft 60. One embodiment shown includes the cylinder 70 rotating about a second cylinder or second cylinder member 80. The second cylinder 80 embodiment shown is a pin. The pin 80 interconnects the cylinder 70 to the shaft 60. The pin 80 may be received by the distal end 60*b* of the shaft 60 by a yoke. The yoke may include a first side 60*ba* and opposing second side 60*bb* adjacent the longitudinal ends of the cylinder 70 and pin 80. A respective through opening 61 of each one of the first and second sides 60*ba*, 60*bb* receives the opposing ends of the pin 80. The first and second sides 60*ba*, 60*bb* define a receiving slot 62 for the cylinder 70 such that the cylinder 70 extends past the distal end 50*b* of the carrier 50 to make rolling contact with the cam surface 39. One or more of the longitudinal ends or a portion of the cylindrical pin 80 may also include a first and second flat sides 81, 82. The longitudinal end with first and second flat sides 81, 82 extends outwardly beyond the outer diameter of the shaft 60 to extend into a longitudinal slot 53 of the carrier 50. The first and second flat sides 81, 82 are parallel to the longitudinal axis Lr of the shaft 60. The opposing first and second flat sides 81, 82 are slideably engaged to the longitudinal slot 53 of the distal end 50*b* of the carrier 50 to not allow rotation of the rolling cam 40 relative to the carrier 50 about the longitudinal axis Lc while still allowing sliding of the rolling cam 40 in the longitudinal direction along the longitudinal axis Lc. Further shown in the embodiments, the pin 80 may not rotate within the through openings 61 because of being rotationally held by the carrier 50.

Figure 4:
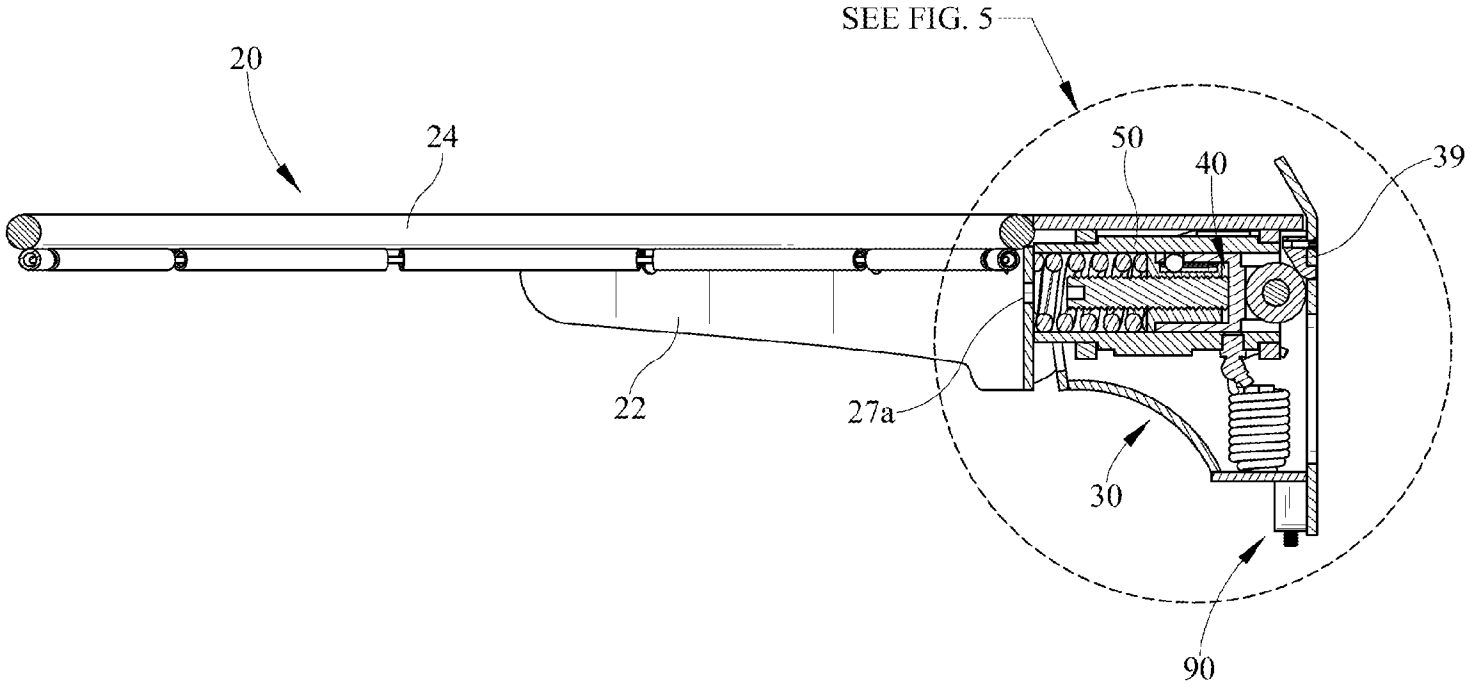
FIG. 4 is a cross-sectional view taken along line 4-4 of FIG. 2, or the midplane of the rim assembly.
Figure 5:
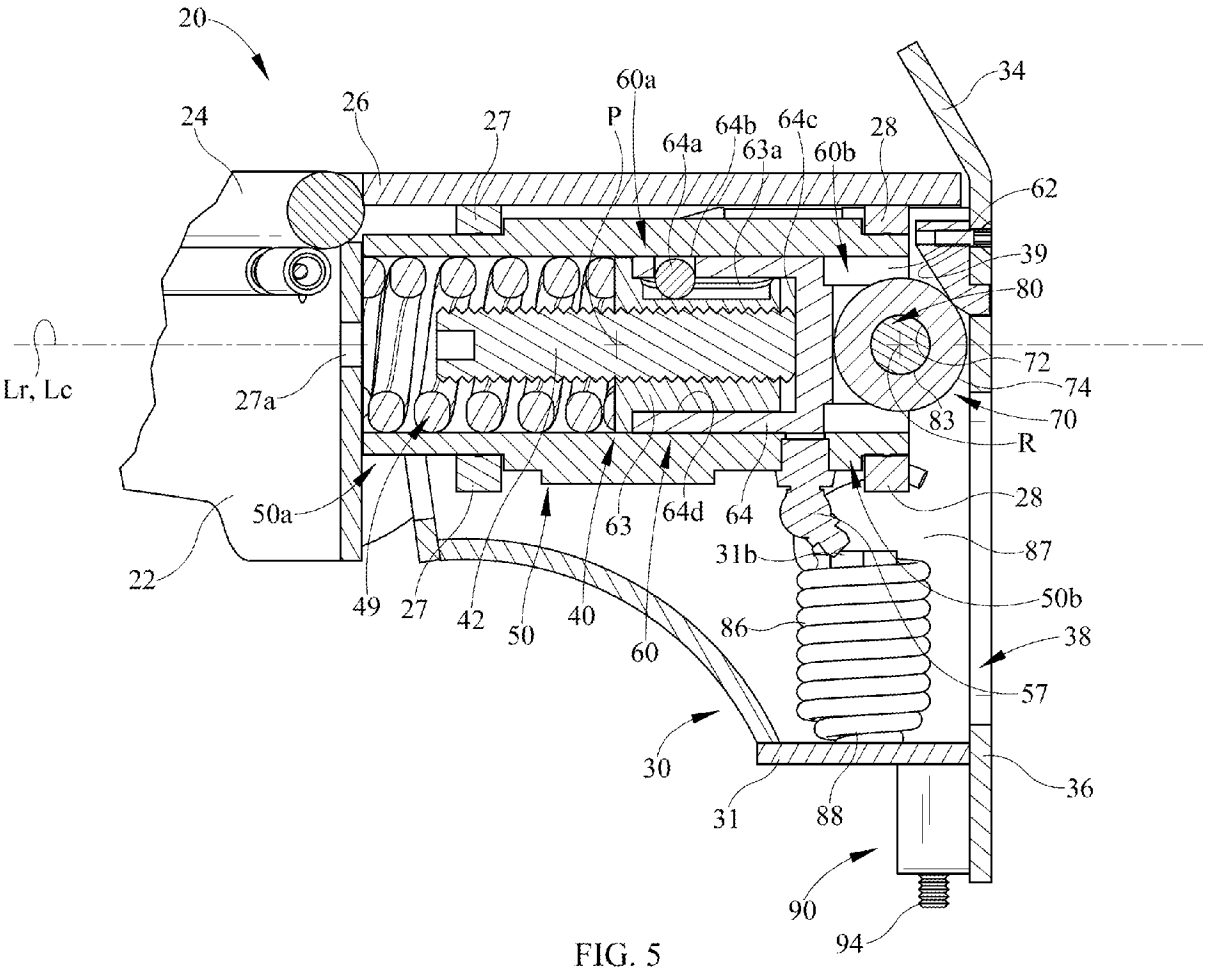
FIG. 5 is an enlarged cross-sectional view as indicated in FIG. 4 taken along line 4-4.
Figure 6:
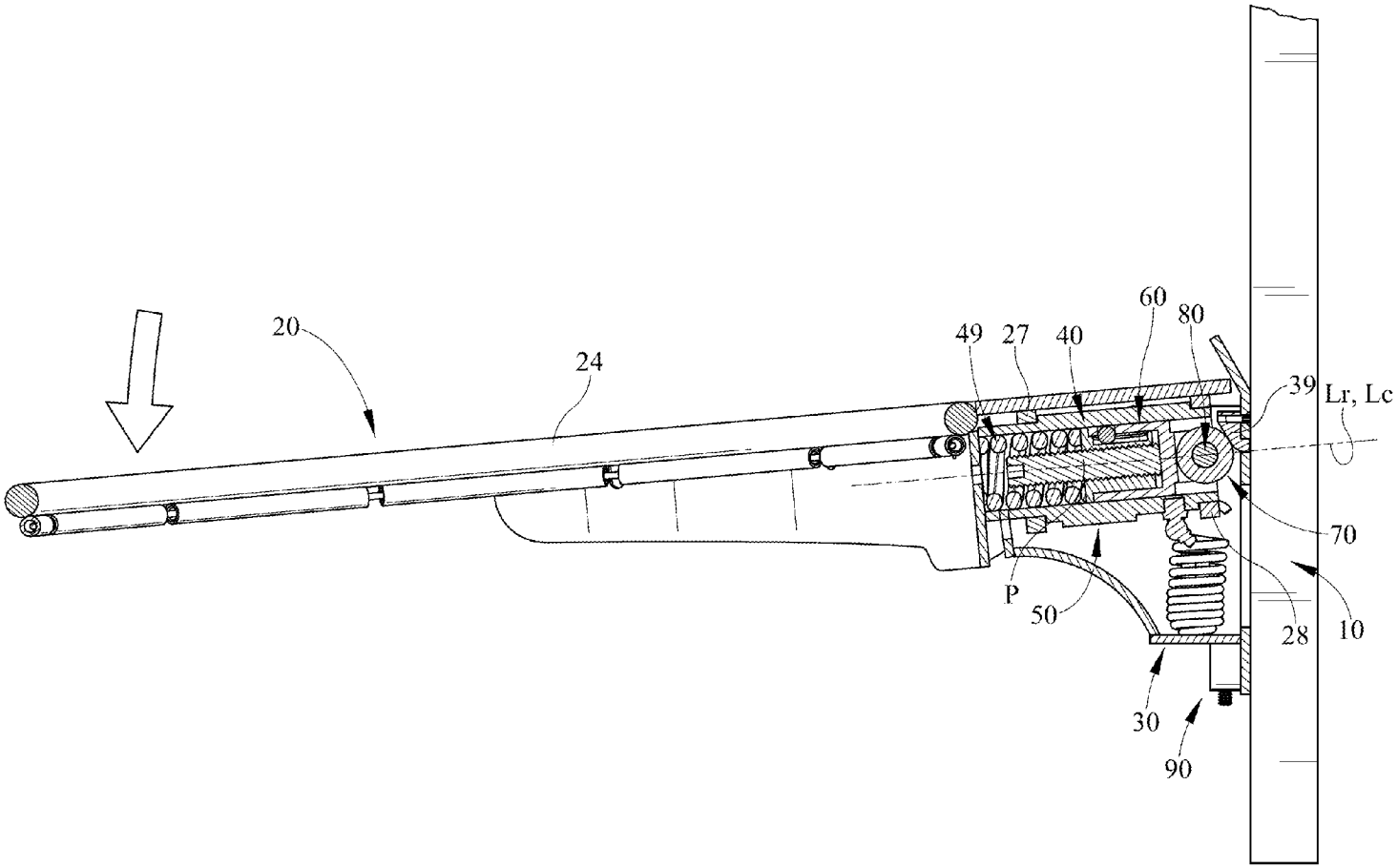
FIG. 6 is a cross-sectional view with the basketball rim assembly being deflected downward away from a rest position into a displaced position.

As illustrated in FIGS. 4-6, the rolling cam 40 is longitudinal biased within the through opening 58 of the carrier 50. The biasing element 49 in the through opening 58 adjacent the proximal end 50*a* of the carrier 50 pivots with the carrier 50 between the rest position and displaced position. The biasing element 49 extends between the arcuate reinforcement 22 of the rim assembly 20 and the proximal end 60*a* of the shaft 60. The biasing force increases from the rest position to the displaced position since the cam surface 39 of the mounting plate 38 forces the rolling cam 40 towards the proximal end 50*a* of the carrier 50, or stated alternatively the distance between the rim arcuate reinforcement 22 or proximal end 49*a* of the biasing element 49 and the cam surface 39 decreases when the carrier 50 is pivoted out of the rest position.

To adjust the force to breakaway or pivot the movable portion 20*a* of the rim assembly 20 relative to the fixed portion 20*b*, the overall length of the shaft 60 can be adjusted by an actuator 42. In the embodiment shown, the actuator 42 is a threaded bolt accessible through an opening 27*a* in the rim arcuate reinforcement 22 of the rim 24 to allow for adjustment of the tension without removing structure or disassembly of rim components. The shaft 60 may include a first member 63 and a second member 64 in a telescoping engagement, with the first member 63 slideably engaging the second member 64. The second member 64 at the distal end 60*b* of the shaft 60 may include the rotating cylinder 70 while the first member 63 may be adjacent the biasing element 49. The first member 63 may not rotate relative to the second member 64 about the longitudinal axis Lr. One embodiment to limit rotation may be a ball and longitudinal groove engagement between contacting surfaces of the shaft first member 63 and second member 64. In one embodiment, the longitudinal groove 63*a* is in the outer cylindrical surface of the first member 63 and receives at least a portion of a ball or ball bearing 64*a* retained by a lateral opening 64*b* the second member. The ball 64*a* longitudinally travels within the groove 63*a* when adjusting the overall length of the shaft 60. However, the ball and groove engagement does not allow rotation of the first member 63 relative to the second member 64 when the actuator 42 is rotated. The actuator 42 is threaded within the first member 63 and one end contacts a bottom surface 64*c* of a longitudinal opening 64*d* facing the biasing element 49. The biasing element 49 extends between the outwardly facing end or radially extending flange 63*b* of the first member 63 or proximal end 60*a* of the shaft 60 and the arcuate reinforcement 22 of the rim 24. As shown, the actuator 42 extends through the biasing element 49. By actuating or threading the actuator 42 in one direction, for example clockwise, the actuator 42 drives or slides the first member 63 away from the second member 64 and thus increases the overall length of the shaft to a first overall length L1 (FIG. 12) thereby increasing the tension applied from the rolling cam 40 to the cam surface 39. Alternatively, if the actuator 42 is threaded along the longitudinal axis in the opposite direction, for example counter clockwise, the first member 63 slides or telescopes towards the second member 64 and thus reducing the overall length to a second overall length L2 (FIG. 11) of the shaft 60 and thereby reducing the tension. As a result, the second overall length L2 is smaller than the first overall length L1.

At least shown in FIG. 6, the longitudinal carrier 50 pivots about its pivoting axis P perpendicular to the longitudinal axis Lc. The carrier 50 can have a longitudinal tubular body 52 that slidable engages the rolling cam 40 and the biasing element 49. A pair of lateral tubular projections 56 extend laterally from the tubular body 52 and have a left end opening 54*a* and a right end opening 54*b*. The left and right end openings 54*a*, 54*b* can be in alignment with side openings 32*a* formed in the bracket plates 32 for receiving one or more fasteners 55. When the carrier 50 is coupled to the bracket plates 32, the lateral tubular projections 56 define the pivot axis P of pivot of the rim assembly. The end openings 54*a*, 54*b* can be threaded in order to be threadably attached with the fasteners 55. The pair of opposing fasteners 55 extends from threaded receiving end openings 54*a*, 54*b* along the pivot axis P laterally away from the outer diameter of the carrier tubular body 52. The fasteners 55 engage the mounting frame 30 that is fixed to the backboard 10 and allows at least the carrier 50, rim 24, biasing element, and rolling cam 40 to pivot about pivot axis P. The carrier 50 allows the rolling cam 40 to pivot along the midplane M of the rim assembly 20 perpendicular to the pivot axis P without rotation about the longitudinal axis Lc. The through opening 58 within the tubular body 52 crosses the pivot axis P aligning the biasing element 49, shaft 60, and cylinder 70 along the longitudinal axis Lc. The inner diameter of the through opening 58 may include a grease port 57 allowing for grease to lubricate the sliding engagement between the exterior diameter of the shaft 60 and the carrier through opening 58. The exterior surface of the carrier tubular body 52 may be substantially cylindrical with each of the proximal end 50*a* and distal end 50*b* being of a lesser outer diameter than the remainder therebetween. The proximal end 50*a* and distal end 50*b* each receive one of a pair of cylindrical eyelets 27, 28 fixed to the rim 24. The larger diameter exterior may provide an inwardly abutment surface 50*c* for each respective eyelet 27, 28 to rest upon or align when assembled. In the embodiment shown, the eyelets 27, 28 are not rotational fixed to the carrier 50 to allow rim rotation about the longitudinal axis Lc of the carrier 50. However, it should be understood that the eyelets or mechanism engaging the rim 24 to the carrier 50 may not allow relative rotation about longitudinal axis Lc in additional embodiments. Further as shown in the figures, the longitudinal slot 53 in the carrier distal end 50*b* extends through the distal end 50*b* portion having the smaller exterior diameter and the portion of the carrier 50 having the larger exterior diameter.

In use, any change in position of the rim 24, which might occur as a result of a downward force on the rim 24, such as from a dunk shot or a player hanging on the rim, may result in a corresponding change in position of the rim 24 and the movable portion 20*a*. FIG. 6 depicts an instance where a downward force being applied approximately at the front of the rim 24 to move the rim 24 to a displaced position away from the horizontal position. The carrier 50 can pivot about the pivot axis P, whereby the proximal end 50*a* is moved downward relative to a horizontal plane formed by the pivot axis P, and the distal end 50*b* can be moved upward relative to the horizontal plane. As a result of the repositioning of the distal end 50*b*, the cylinder 70 at the second end of the shaft rolls upward along the cam surface 39 of the mounting plate 38, with biasing element 49 applying the biasing force in a linear path against the cam surface 39. The degree of angularity of the forward extending portion 34 and/or the cam surface 39 can permit an increasingly larger resistance to the breakaway of the rim due to the rolling cam 40 being displaced farther in the forward direction.

In response, the rolling cam 40 and biasing element 49 can reactively pivot about the pivot axis P so that the biasing element 49 is farther compressed between the shaft 60 and the arcuate reinforcement 22, which can increase the resistance. Further, the rear eyelet 28 may move the lower end 88 of the tension members 84, 86 in an upward direction, and may further extend the tension members to increase the resistance caused thereby.

Upon release of the rim 24 from its displaced position (FIG. 6), the biasing force provided by the tension members 84, 86 and/or the biasing element 49 can cause the cylinder 70 of the rolling cam 40 to roll to the lower end of the cam surface 39 thereby bringing the carrier's longitudinal axis Lc and the rim 24 substantially parallel to the horizontal plane. To this end, the carrier 50 is returned to its original rest position and the rim is returned to its horizontal position. This return of the carrier 50 to its rest position may allow the top plate 26 to also return to its original position.

As shown in FIG. 1, the rim 24 may be able to not only pivot relative to the fixed portion 20*b*, but alternative embodiments may also rotate about the longitudinal axis Lc for a predetermined degree of rotation. With the eyelets 27, 28 engaging the carrier 50, the rim 24 with fixed eyelets 27, 28 are able to rotate about the longitudinal axis Lc of the carrier 50. The rotation of the rim 24 about the longitudinal axis Lc may occur at a variety of orientations of the carrier 50 relative to the fixed portion 20*b*. The rotation of the rim 24 about the longitudinal axis Lc of the carrier 50 may occur, but is not limited to, when the rim 24 or movable portion 20*a* is out of the rest position. However for example, the rim may rotate when in the rest position as well as when out of the rest position. For another example the rim 24 may rotate about the longitudinal axis Lc of the carrier 50 when in the rest position and then continue to increase the range of rotation when traveling away from the rest position. As such, the mounting frame 30 may stop the degree of pivoting and/or rotating of the rim.

Figure 7:
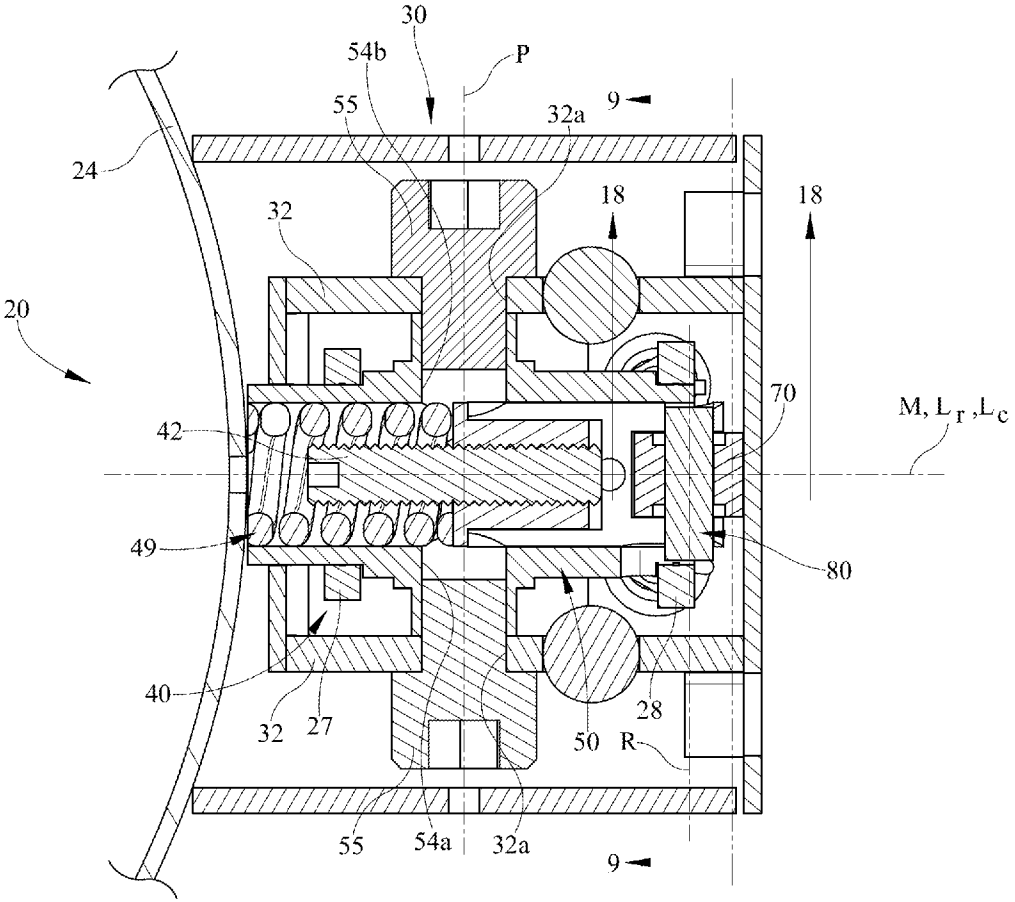
FIG. 7 is a cross-sectional view taken along line 7-7 of FIG. 3 of the basketball rim assembly in a rest position.
Figure 8:
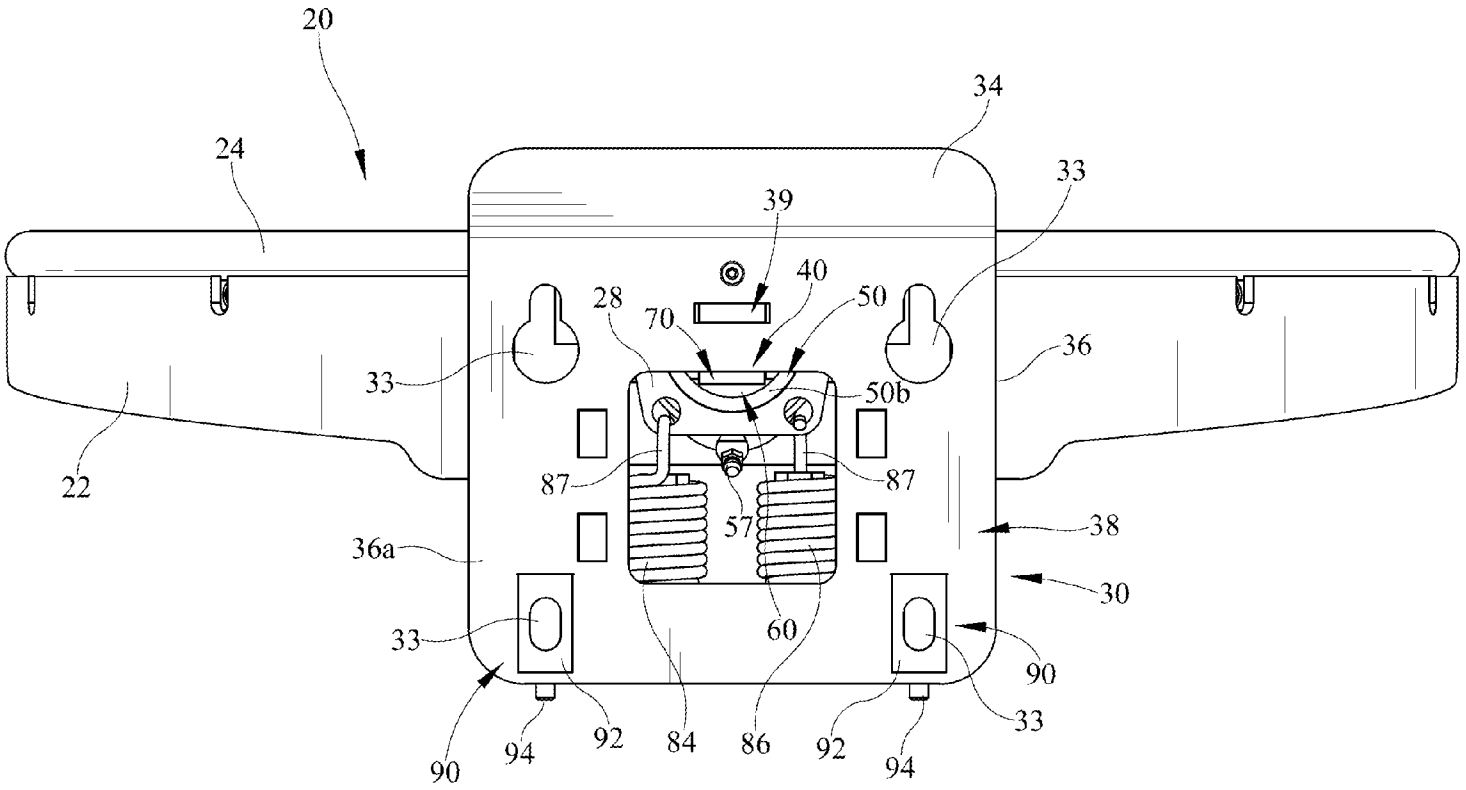
FIG. 8 is a rear view of the basketball rim assembly in a rest position.
Figure 9:
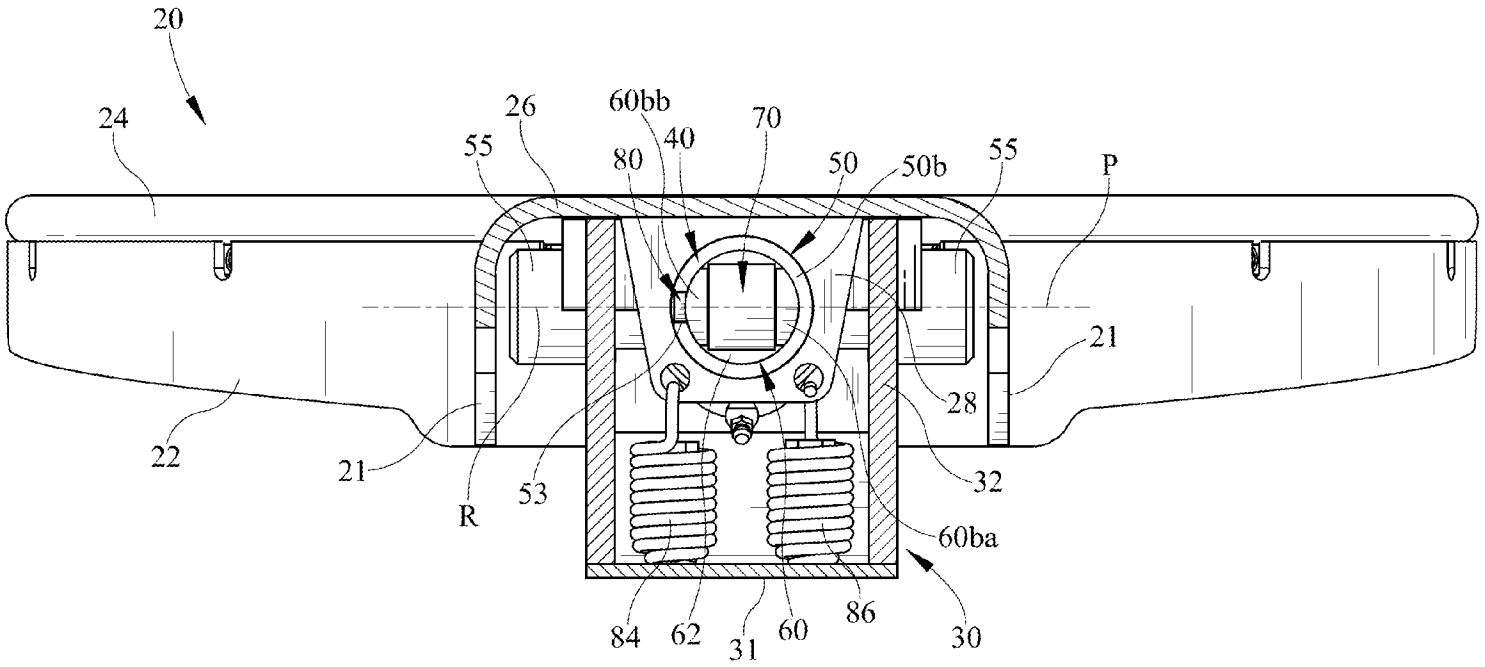
FIG. 9 is a cross-sectional view taken along line 9-9 of FIG. 7 of the basketball rim assembly with the cam surface removed.
Figure 10:
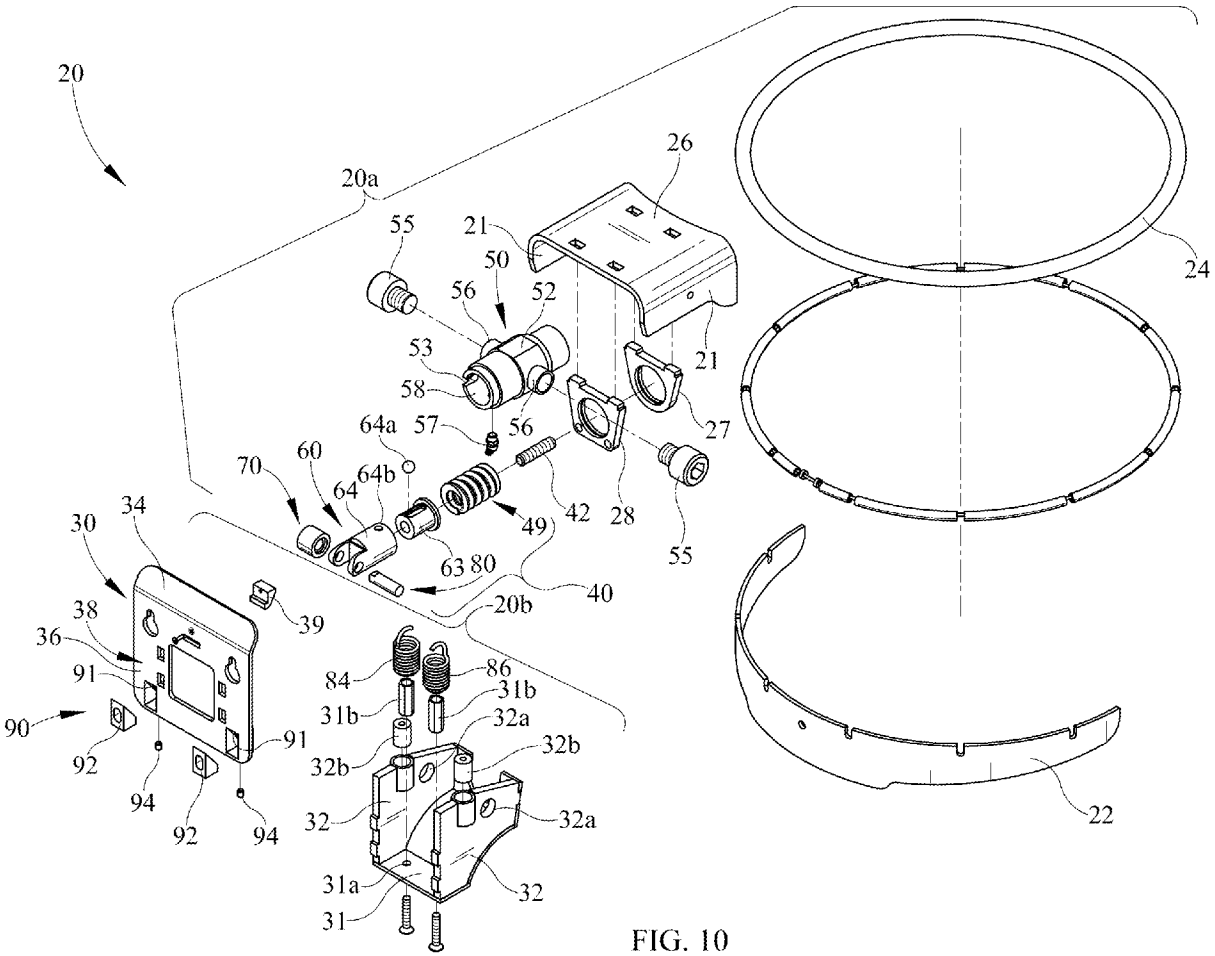
FIG. 10 is an exploded view of the basketball rim assembly of FIG. 1.

As is shown in the figures, at least the rim 24 may be coupled to tension members 84, 86, such as tension springs, configured to bias the rim 24 in a predefined orientation. For example, a pair of springs may be attached to the rear eyelet 28 at the distal end 50*b* of the carrier 50. The left and right tension members 84, 86 are preferably spaced equidistant from a midplane M defined by the longitudinal axis Lr of the rolling cam 40, as shown in FIG. 7. As shown in FIG. 5, a lower end 88, opposite the hook end 87, such as a spring coil portion, of the tension members 84, 86 can be coupled to the base plate 31. The lower end 88 can be coupled to the base plate 31 so that the tension members 84, 86 are vertically oriented. In one example, the base plate 31 includes an opening 31*a* for receiving and mounting a guiding rod 31*b*, such as a threaded screw, that extends upright from the base plate 31. An upper end portion of the guiding rod 31*b* can be inserted through an aperture defined by the lower end 88 of the tension member 84, 86. It is contemplated that the tension members 84, 86 can be situated as compression members as appreciated by those skilled in the art. In use, the tension members 84, 86 can resist rotational effects of the rim 24 about the longitudinal axis Lc. If used, the tension members 84, 86 may also assist to urge or to pivot the movable portion 20*a* back to the rest position. It is also shown that the one or more rubber stops or pads 32*b* may be positioned between the fixed portion 20*b* and movable portion 20*a* to prevent metal to metal contact during a range of relative motion between the fixed and movable portions. In particular, the pads 32*b* may dampen the rim 24 return from the displaced position to the rest position. It can also be shown in the figures that the rotation of the rim 24 about the longitudinal axis Lc may be independent of the rolling cam 40. As a result, the cylinder 70 of the rolling cam 40 rolls in a substantially linear path regardless of the rotation of the rim 24 about the longitudinal axis Lc. As such the rim 24 may be constructed without rotational movement if desired.

Figure 16:
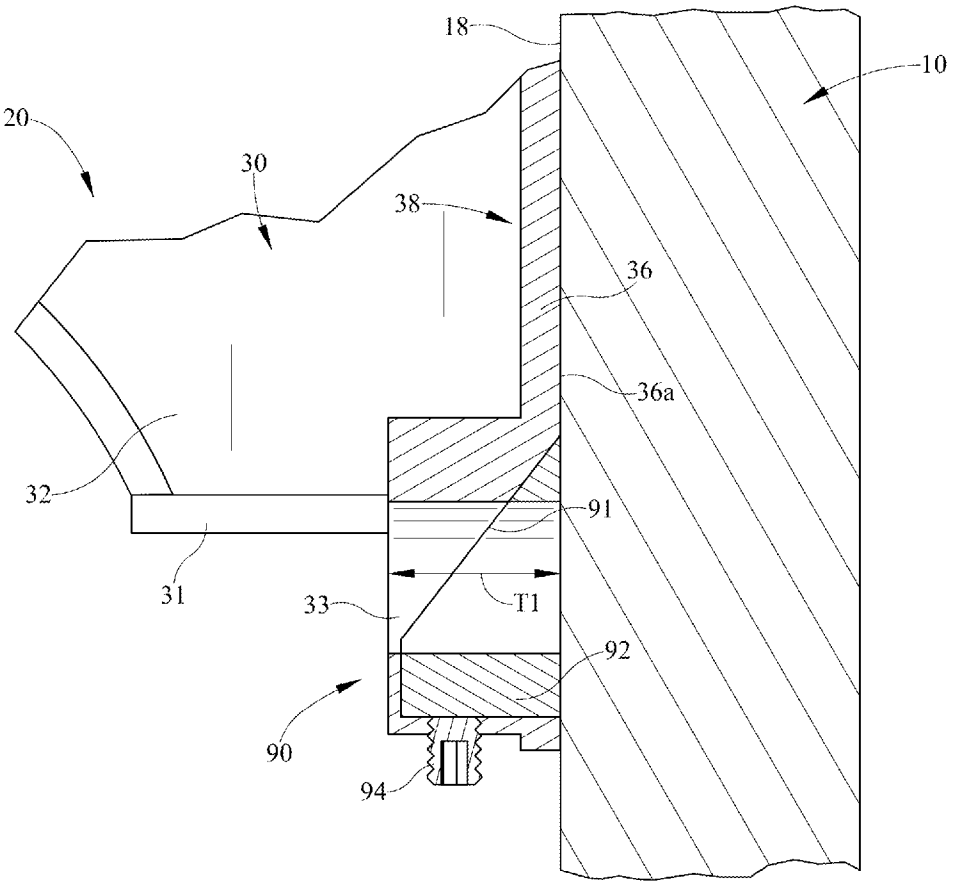
FIG. 16 is an enlarged cross-sectional view taken along line 16-16 of FIG. 15 illustrating a first position of a wedge relative to the mounting plate, or more specifically the inclined surface of the mounting plate, with a mounting bolt removed.
Figure 17:
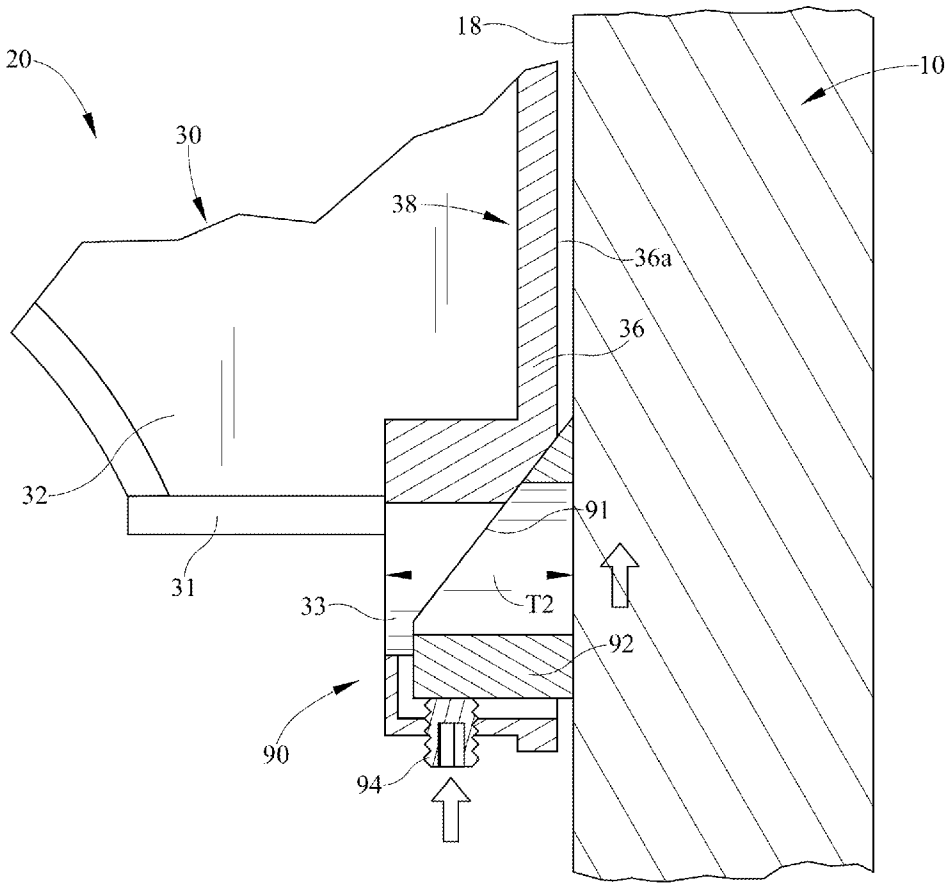
FIG. 17 is an enlarged cross-sectional view taken along line 16-16 of FIG. 15 illustrating a second position of a wedge relative to the mounting plate, or more specifically the inclined surface of the mounting plate, with a mounting bolt removed.

As illustrated in FIGS. 16 and 17, the rim assembly 20 may include a leveling mechanism 90 to allow for leveling of the rim 24 to a substantially horizontal orientation relative to the substantially vertical basketball backboard 10. Instead of washers previously used to level typical rims, the mounting frame 30 includes a leveling mechanism 90 having one or more inclined surfaces 91 slidingly engaging a corresponding one or more wedges 92. Each set of inclined surface 91 and wedge 92 may define the through opening 33 for receiving a bolt to secure the rim assembly 20 to the backboard 10. The mounting plate 38 includes the inclined surface 91 spaced from the abutment surface 36*a* of the planar portion 36. The wedge 92 engages the inclined surface 91 and may be driven by an actuator 94 from a first position (FIG. 16) to a second position (FIG. 17). One embodiment of the actuator 94 is a set screw as shown. The actuator 94 may operably position the wedge 92 in relation to the inclined surface 91. The actuator 94 can drive the wedge 92 up the inclined surface 91 to the second position and/or allow the wedge 92 to travel down to the first position. When in the first position (FIG. 16), the wedge 92 and inclined surface 91 engagement creates a first thickness T1. When in the second position (FIG. 17), the wedge 92 and inclined surface 91 engagement creates a second thickness T2, wherein the second thickness T2 is larger than the first thickness T1. When having a second thickness T2, the wedge 92 may project past the abutment surface 36*a* as shown in FIG. 17 spacing the abutment surface 36*a* from the backboard 10. With the one or more leveling mechanisms 90 shown in one embodiment at the lower end of the mounting plate 38, in use the user can raise portions of or the front of the rim 24 by increasing the thickness to the second thickness T2 in one or more of the leveling mechanisms 90. Further in use, by decreasing the thickness to the first thickness T1, the front of the rim 24 or portions thereof can be lowered in relation to the vertical backboard 10. It may also be advantages to have adhesive tape (not shown) to temporarily hold the wedge 92 in contact with the inclined surface 91 before mounting the rim assembly 20 to the backboard 10. However, a variety of embodiments, other than adhesive, may have additional structure to maintain capture of the wedge in relation to the mounting plate 38 for handling purposes.

Figure 18:
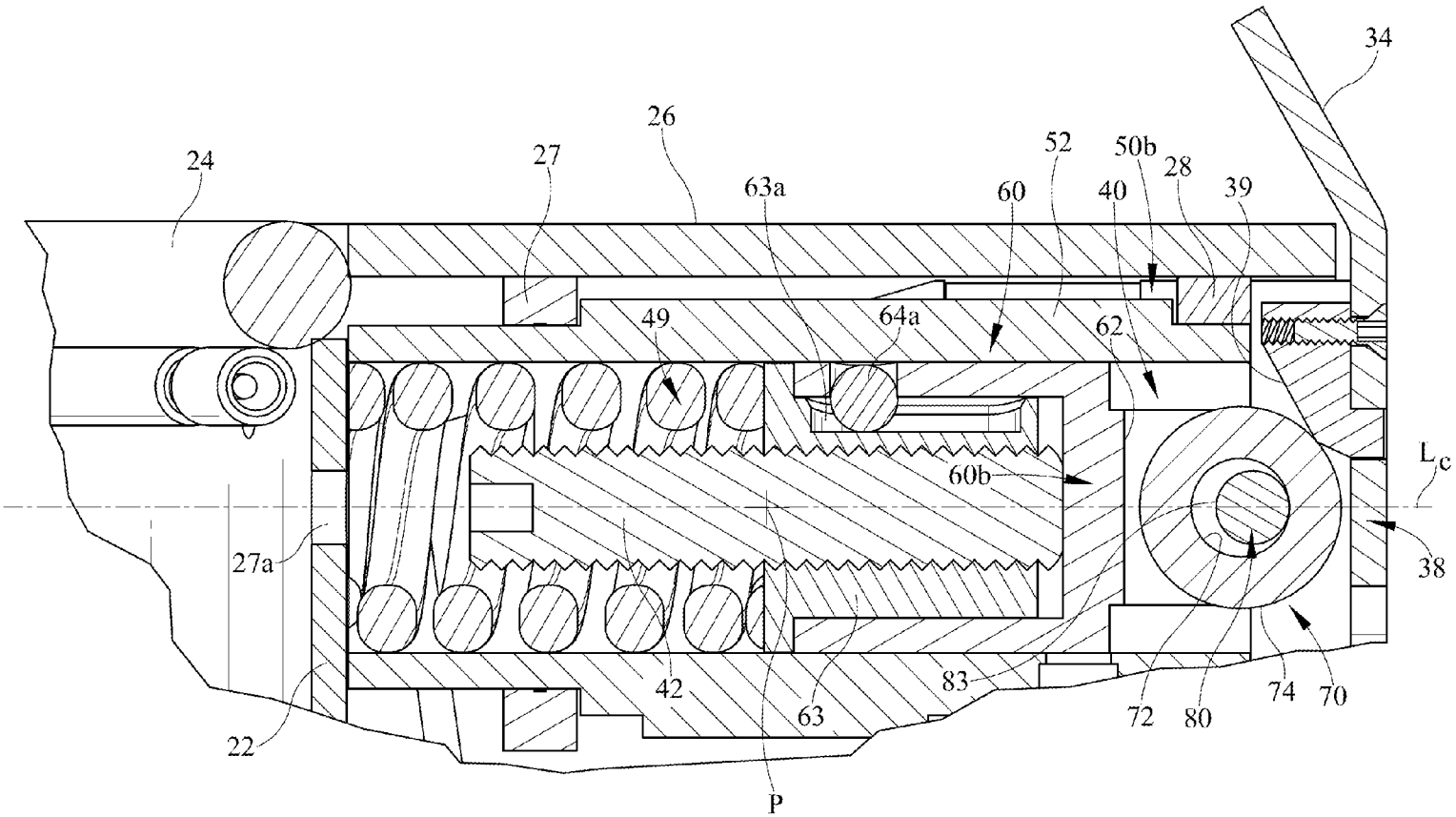
FIG. 18 is an enlarged cross-sectional view taken along line 18-18 of FIG. 7 illustrating the clearance between pin and cylinder in a first position with the rim in a horizontal position of FIG. 1.
Figure 19:
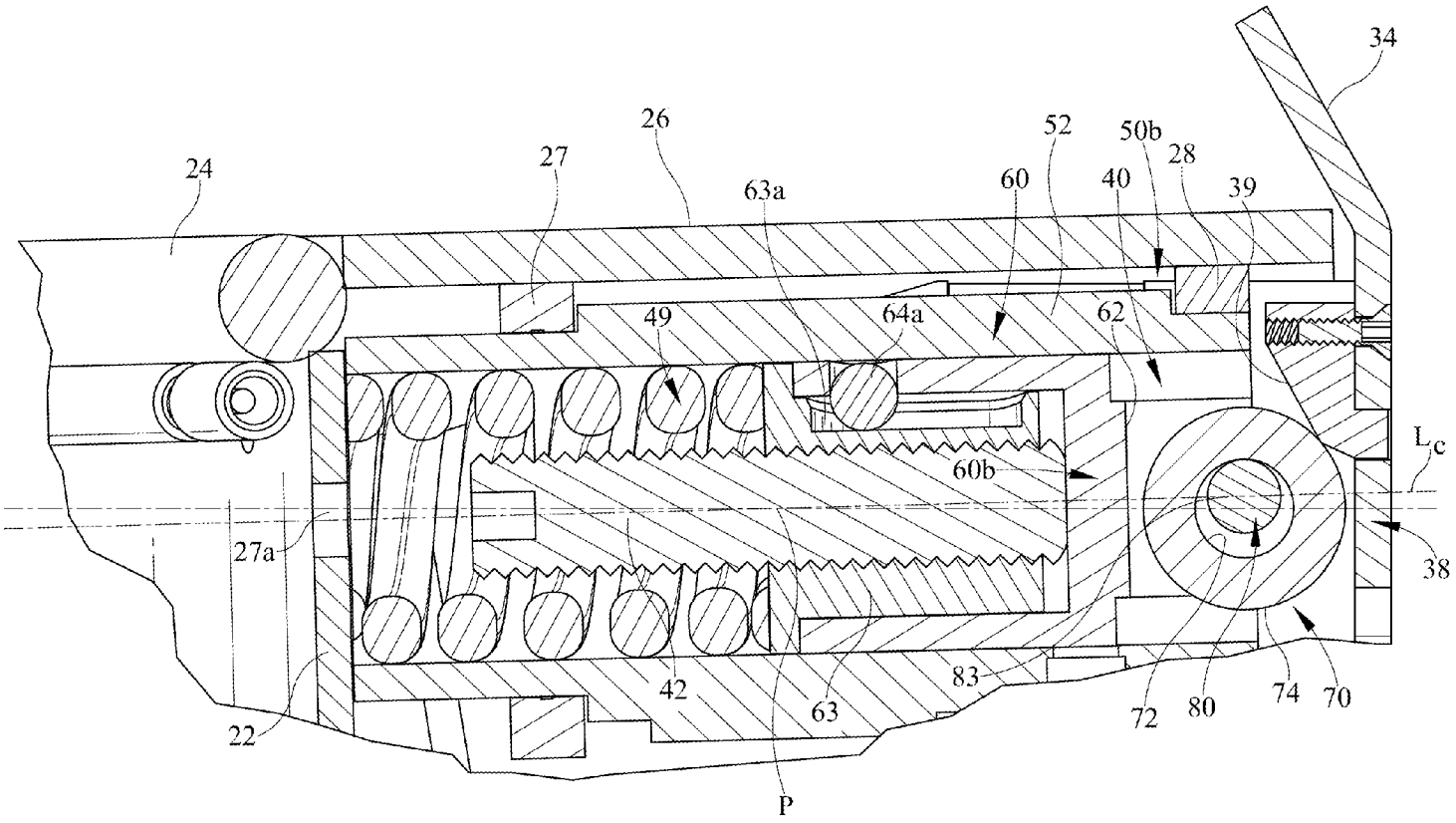
FIG. 19 is an enlarged cross-sectional view taken along line 18-18 of FIG. 7 illustrating the pin in a different or second position within the clearance between the pin and the cylinder with the rim in a deflected or non-horizontal position, and further illustrating the cylinder is in substantially the same position against the cam surface of the mounting plate of FIG. 18.

An additional embodiment is shown in FIGS. 18 and 19, if desired an engagement between the pin 80 and the cylinder 70 may provide for the rim 24 to be bumped or moved relative to pivot axis P without operating the breakaway feature of the basketball rim assembly 20. Stated alternatively, the rim assembly 20 may distinguish between the force of a basketball shot hitting the rim 24 as compared the forces of a dunk upon the rim 24 that results in the rim breaking away. The movable portion 20*a* or rolling cam 40 may include a second cam surface 72 in the linkage between the pivot axis P and the outer cylindrical surface 74, or could be said to be in series with the first cam surface 39. In the embodiment shown, the second cam surface 72 is the inner cylindrical surface of the cylinder 70. The inner cylindrical surface 72 of the cylinder 70 includes an inner diameter. As opposed to a friction fit or press fit between pin 80 and the cylinder 70, the pin 80 may change positions in relation to the inner through opening defined by the inner cylindrical surface 72 of the cylinder 70, or more specifically travel upon the inner cylindrical surface 72. The pin 80 includes an outer cylindrical surface 83 with an outer diameter. The cylinder's 70 inner diameter is larger than an outer diameter of the pin 80 whereby a space or clearance is defined therebetween. This space or clearance may be exaggerated in FIGS. 18 and 19 to illustrate the available relative movement. A longitudinal axis of the pin 80 is out of alignment with a longitudinal axis of the cylinder 70, this is more readily shown when in the rest position of FIG. 18. In the embodiment shown in FIG. 18, a crescent shape clearance is defined when pin 80 applies the straight-line pressure along the longitudinal axis Lc to the inner cylindrical surface 72 of the cylinder 70 and subsequently to the cam surface 39. As a result, the clearance therebetween allows for the pin 80 and connected shaft 60, carrier 50, and rim 24 to have a degree of freedom to pivot about the pivot axis P without pivoting the cylinder 70 out of the rest position. The pin 80 and cylinder 70 in the rest position is shown in FIG. 18. Any adjustment of the biasing element 49 does not change the respective clearance available with respect to the second cam surface 72, and alternatively changing the amount of clearance between the pin 80 and cylinder 70 does not affect the pressure that can be applied. Therefore, the first displacement of pin 80 in relation to the second cam surface 72 or cylinder 70 at a variety of pressures may result in a corresponding movement or pivot of the rim 24 depending on the amount of clearance provided. Further if the second cam surface 72 is used with the clearance between the pin 80 and cylinder 70, the first displacement of the pin 80 and subsequent rim 24 movement occurs before the rolling contact of the cylinder 70 and first cam surface 39 occurs, if and when this breakaway and rolling contact even occurs. Stated alternatively, if the pin 80 cannot travel further within the clearance or relative to the second cam surface 72, the force applied to the rim may be sufficient enough to pivot the cylinder 70 from the rest position (FIGS. 5 and 18) to the displaced position (FIG. 6 in order to provide the breakaway. The breaking away of the rim 24 results in a larger second displacement that encompasses the first displacement of the rim 24 due to the pin clearance relative to the second cam surface 72. As mentioned above, it may also be desired to adjust the first displacement or rim bump by selecting a predetermined variance between the outer diameter of the pin 80 and the inner diameter of the cylinder 70 to obtain varying degree of first displacements or clearance to achieve different results or degree of rim movement and/or pivot before the breakaway occurs. Stated alternatively, the larger the difference in diameters the more displacement of the rim before the rim breaks away.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure. Further, it is to be understood that continuously or substantially continuously may include one or more interruptions, delays, etc. in controlling characteristics such as but not limited to the quantities, rates, measurements disclosed herein and still be within the scope of the embodiments. Alternatively, control or adjustments may be considered or provided intermittently.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." When used in this description and the claims as an adjective rather than a preposition, "about" means "approximately" and comprises the stated value and every value within 10% of that value. For example, "about 100%" would include measurements of 90% and 110%, as well as every value in between. The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The foregoing description of several methods and embodiments have been presented for purposes of illustration. It is not intended to be exhaustive or to limit the precise steps and/or forms disclosed, and obviously many modifications and variations are possible in light of the above teaching. It is intended that the scope and all equivalents be defined by the claims appended hereto.

The invention claimed is:

1. A basketball rim apparatus comprising:

a fixed portion having a mounting plate, wherein said mounting plate includes a cam surface, and said mounting plate adapted to secure to a backboard;

a movable portion having a rim and a carrier, wherein said rim and said carrier are pivotable relative to said mounting plate from a rest position to a displaced position out of said rest position;

wherein said carrier includes an elongated shaft, a cylinder, a pin, and a tension spring;

wherein said elongated shaft includes a first end and a second end;

wherein said cylinder includes an inner cylindrical surface and an outer cylindrical surface extending between opposing ends, said inner cylindrical surface having an inner diameter and said outer cylindrical surface having an outer diameter, wherein said inner diameter is smaller than said outer diameter, and a longitudinal axis of said cylinder extends in a direction between said opposing ends;

wherein said pin is positioned at said second end of said elongated shaft, and said pin is positioned within said cylinder wherein said cylinder rotates about a longitudinal axis of said pin, and wherein said pin is smaller than said inner diameter of said cylinder to define a clearance therebetween; and wherein said tension spring is connected to said shaft to maintain contact between said outer cylindrical surface of said cylinder against said cam surface and urges said rim and said carrier to return to said rest position from said displaced position, and said longitudinal axis of said pin is out of alignment with said longitudinal axis of said cylinder when said tension spring is maintaining contact between said outer cylindrical surface of said cylinder against said cam surface.

2. The basketball rim apparatus of claim 1 wherein said pin includes an outer diameter, wherein said outer diameter of said pin is smaller than said inner diameter of said cylinder to define said clearance therebetween, wherein said clearance is substantially crescent shaped when said tension spring is maintaining contact between said outer cylindrical surface of said cylinder against said cam surface.

3. The basketball rim apparatus of claim 1 wherein said outer cylindrical surface of said cylinder is in a rolling engagement with said cam surface between said rest position and said displaced position.

4. The basketball rim apparatus of claim 1 wherein said second end of said shaft includes a first side and an opposing second side, wherein said first side and said second side are on said opposing ends of said cylinder and receive opposing ends of said pin.

5. The basketball rim apparatus of claim 1 wherein said elongated shaft includes a longitudinal axis between said first end and said second end, wherein said longitudinal axis of said cylinder is perpendicular to said longitudinal axis of said elongated shaft.

6. The basketball rim apparatus of claim 1 wherein said mounting plate includes one or more wedges for leveling said rim relative to a backboard.

7. A basketball rim apparatus comprising:

a fixed portion including a mounting frame, wherein said mounting frame includes a cam surface and said fixed portion is adapted to be secured to a backboard;

a movable portion includes a longitudinal carrier and a rim pivotable from a rest position to a displaced position;

said longitudinal carrier having a longitudinal axis extending from a first end to a second end and a through opening extending along said longitudinal axis, wherein said carrier is pivotably connected to said mounting frame about a pivoting axis whereby said movable portion pivots relative to said mounting frame about said pivoting axis, wherein said pivoting axis is substantially perpendicular to said longitudinal axis, and wherein said longitudinal carrier further includes a biasing element and a shaft, wherein said shaft is slidingly positioned within said through opening of said carrier, wherein a distal end of said shaft includes a cylinder rotating about a rotational axis perpendicular to said longitudinal axis, and wherein said biasing element tensions said cylinder against said cam surface of said mounting frame urging said movable portion to return from said displaced position to said rest position; and wherein said longitudinal carrier further includes a pin interconnecting said cylinder to said shaft whereby said cylinder rotates about said pin, wherein said cylinder includes an inner cylindrical surface receiving said pin, wherein said pin is smaller in diameter than said inner cylindrical surface of said cylinder to define a clearance therebetween, and wherein said pin is not coaxially aligned with said inner cylindrical surface when said cylinder is tensioned against said cam surface.

8. The basketball rim apparatus of claim 7 wherein said cylinder is in a rolling engagement with said cam surface.

9. The basketball rim apparatus of claim 7 wherein said biasing element is a spring positioned along said longitudinal axis within said through opening of said carrier.

10. The basketball rim apparatus of claim 7 wherein said biasing element is adjustable to either increase or decrease the pressure applied between said cylinder and said cam surface.

11. The basketball rim apparatus of claim 7 wherein said mounting frame includes a back plate adapted to engage a backboard, wherein said back plate includes one or more inclined surfaces and one or more wedges slidingly engaging a respective said one or more inclined surfaces.

12. A basketball rim apparatus comprising:

a movable portion having a rim, a biasing element, a longitudinal carrier, and a rolling cam, wherein said rolling cam includes a cylinder rotating about a pin, wherein said rolling cam is in a sliding engagement with said carrier, wherein said biasing element engages said rolling cam in said sliding engagement with said carrier, wherein said cylinder includes an outer cylindrical surface and an inner cylindrical surface, wherein said pin is smaller in diameter than said inner cylindrical surface of said cylinder to define a clearance therebetween, and said inner cylindrical surface of said cylinder is a first cam surface;

a fixed portion having a second cam surface, wherein said fixed portion is adapted to be secured to a basketball backboard;

wherein said outer cylindrical surface of said rolling cam cylinder operably engages said second cam surface of said fixed portion;

wherein said pin of said rolling cam operably engages said first cam surface; wherein said rim, said biasing element, said longitudinal carrier, and said pin of said rolling cam pivot a first displacement relative to said cylinder of said rolling cam and said fixed portion about a pivot axis; and wherein said rim, said biasing element, said longitudinal carrier, and said rolling cam pivot a second displacement relative to said fixed portion about said pivot axis between a rest position to a displaced position out of said rest position;

wherein said first displacement about said pivot axis is less than said second displacement about said pivot axis.

13. The basketball rim apparatus of claim 12 wherein said rim rotates about a longitudinal axis of said carrier and said rolling cam.

14. The basketball rim apparatus of claim 12 wherein said cylinder is in a rolling engagement with said second cam surface.

15. The basketball rim apparatus of claim 12 wherein said rolling cam does not rotate relative to said carrier.

16. The basketball rim apparatus of claim 12 wherein said rolling cam includes a shaft, wherein said shaft includes a first member in a telescoping engagement with a second member.

17. The basketball rim apparatus of claim 12 wherein said rim is out of said rest position at said first displacement.

18. The basketball rim apparatus of claim 12 wherein said first displacement is defined by said clearance between said pin and said cylinder.

* * * * *